US006746349B2

(12) United States Patent
Neiberger et al.

(10) Patent No.: US 6,746,349 B2
(45) Date of Patent: Jun. 8, 2004

(54) BASKETBALL NET

(76) Inventors: Sean Allen Neiberger, P.O. Box 25543, Los Angeles, CA (US) 90025; Ian Reed Kaiser, 28711 Pacific Coast Hwy., Unit #19, Malibu, CA (US) 90025

( * ) Notice: Subject to any disclaimer, the term of this patent is extended or adjusted under 35 U.S.C. 154(b) by 0 days.

(21) Appl. No.: 10/406,935

(22) Filed: Apr. 3, 2003

(65) Prior Publication Data

US 2003/0190985 A1 Oct. 9, 2003

Related U.S. Application Data

(60) Provisional application No. 60/370,124, filed on Apr. 5, 2002.

(51) Int. Cl.[7] ..... A63B 63/08
(52) U.S. Cl. ..... 473/485; 473/489
(58) Field of Search ..... 473/485, 433, 473/449, 447, 448, 483, 486, 487, 489; 273/317.3; D21/701

(56) References Cited

U.S. PATENT DOCUMENTS

| | | | |
|---|---|---|---|
| 2,199,609 | A | 5/1940 | Bennett |
| 2,579,312 | A | 12/1951 | Garvey |
| 3,109,647 | A | 11/1963 | Austin |
| 3,313,539 | A | 4/1967 | Michael |
| 3,595,573 | A | 7/1971 | Kilbourne |
| 3,945,638 | A | 3/1976 | Luebkeman |
| 3,948,516 | A | 4/1976 | Jones, Sr. |
| 4,071,238 | A | 1/1978 | Chapman |
| 4,353,548 | A | 10/1982 | Mahoney |
| 4,397,464 | A | 8/1983 | Krug |
| 4,805,903 | A | 2/1989 | McArdle |
| 4,834,368 | A | 5/1989 | Qualley |
| 4,877,241 | A | 10/1989 | Rothbard |
| 4,903,964 | A | 2/1990 | Anderson |
| 4,905,995 | A | 3/1990 | Apo |
| 4,965,115 | A | 10/1990 | Cimillo |
| 5,098,091 | A | 3/1992 | McGivern |
| 5,123,642 | A | 6/1992 | Stokes |
| 5,305,997 | A | 4/1994 | Jolly |
| 5,338,023 | A | 8/1994 | Stovall |
| 5,360,208 | A | 11/1994 | Fang |
| 5,382,017 | A | 1/1995 | Pippert |
| 5,405,132 | A | 4/1995 | St. Onge |
| 5,447,304 | A | 9/1995 | Vargas |
| 5,458,325 | A | 10/1995 | Klein et al. |
| 5,524,883 | A | 6/1996 | Allen et al. |
| 5,575,470 | A | 11/1996 | Sherman |
| 5,584,479 | A | 12/1996 | Smith |

(List continued on next page.)

FOREIGN PATENT DOCUMENTS

| | | |
|---|---|---|
| EP | O 329 893 | 11/1988 |
| EP | O 692 282 A1 | 7/1995 |
| WO | WO 98/06461 | 2/1998 |
| WO | WO 99/21622 | 5/1999 |

*Primary Examiner*—Gregory Vidovich
*Assistant Examiner*—M. Chambers
(74) *Attorney, Agent, or Firm*—Fulbright & Jaworski LLP

(57) ABSTRACT

The disclosed basketball net has an integrally formed resilient net-like body of a generally tapered configuration. A connected undulating central waist portion of the body is defined by a series of oppositely disposed upper and lower cutouts to facilitate limited stretching of the net-like body about its waist. A connected undulating lower portion of the body facilitates limited stretching of the net-like body about its lower circumference. The overall shape of the net and its cutouts is adapted to provide an interaction with a regulation basketball similar to that of a conventional nylon basketball net. In one embodiment, the net is fastened to a conventional basketball hoop by a strap in the form of a high-strength metallic cable. In that embodiment, a male clip having a downwardly extending tongue is attached to the body and is connected by the strap to a female clip having a corresponding aperture.

13 Claims, 6 Drawing Sheets

U.S. PATENT DOCUMENTS

| | | | |
|---|---|---|---|
| 5,603,496 | A | 2/1997 | Rappaport |
| 5,613,676 | A | 3/1997 | Connolly |
| 5,634,733 | A | 6/1997 | Sperduti |
| 5,672,130 | A | 9/1997 | O-Connell et al. |
| 5,735,760 | A | 4/1998 | Brewer |
| D397,384 | S | 8/1998 | DeArmond |
| 5,795,253 | A | 8/1998 | Allen |
| 5,827,136 | A | 10/1998 | Halter et al. |
| 5,830,088 | A | 11/1998 | Franklin de Abreu |
| 5,909,833 | A | 6/1999 | Smith |
| 5,944,623 | A | 8/1999 | Schlicting |
| 5,951,416 | A | 9/1999 | Allen et al. |
| 6,074,313 | A | 6/2000 | Pearson |
| 6,080,071 | A | 6/2000 | Childers et al. |
| 6,174,249 | B1 | 1/2001 | Mattoon |
| 6,264,573 | B1 | 7/2001 | Zheng |
| 6,312,350 | B1 | 11/2001 | White |

74
66
64
70
68
76
65
52
62
22
72

BASKETBALL NET

This application is based on Provisional Patent Application Serial No. 60/370,124, filed on Apr. 5, 2002.

FIELD OF THE INVENTION

The present invention relates generally to basketball nets and more particularly to a basketball net constructed from a durable and resilient compound.

PRIOR ART

One purpose of a basketball net is to catch and slow down the path of a ball so the ball falls out in close proximity to the basket. Another purpose of a basketball net is to indicate to the player(s) if the ball went through the rim at all. Historically, basketball nets have been constructed from nylon cord woven or tied into a net-like structure which is generally conical in shape and available in various colors for use in both indoor and outdoor games. Nylon is used mainly because it is a relatively inexpensive material and is easy to manufacture. However, one unresolved issue related to use of nylon as a basketball net building material has always been its lack of durability.

Not long after a nylon-based basketball net is installed, the net begins to show wear and tear due to the repetitive action of the ball going through it. When the basketball net is used outdoors, the deterioration process increases dramatically due to environmental exposure whereby sunlight, rain, snow, cold, heat, wind and chemical pollutants in the air all contribute to the rapid break down of the nylon net.

In an attempt to resolve this problem, basketball net manufacturers have turned to alternative materials such as metal chain. A metal chain net is somewhat better suited to withstand the harsh effects of the environment, however, if used on a regular basis, the chain net tends to break down even quicker than a nylon net. The constant pounding and stress a ball puts on a metal chain net gradually weakens the links and once links begin to break, the net becomes ineffective and even dangerous. In fact, a metal chain basketball net usually comes with a warning label from the manufacturer requesting the user to wear a mouth guard while performing slam-dunk maneuvers to avoid getting teeth caught in the net.

On the other hand, playing basketball without a net is frustrating because after each shot the user is forced to chase the ball all over the court. During competitive play, various issues may arise such as, for example, whether a basket was made at all or not. If the basketball does not come in contact with the backboard or rim, it is normally rather difficult to decide if the basketball went through the rim or not. Consequently, players tend to avoid basketball courts not equipped with basketball nets. Furthermore, having to constantly expend time and money to maintain and/or replace nylon or metal-based basketball nets, is obviously not a welcome proposition for the user.

SUMMARY OF THE INVENTION

An improved basketball net suitable for indoor and/or outdoor game is similar in look, feel and performance to the traditional nylon net, but is much stronger and more durable. It includes an integrally formed resilient net-like body of a generally tapered configuration. A connected undulating central waist portion of the body is defined by a series of oppositely disposed upper and lower cutouts to facilitate limited stretching of the net-like body about its waist. A connected undulating lower portion of the body facilitates limited stretching of the net-like body about its lower circumference.

In certain presently contemplated embodiments, the body of the net may be constructed from a durable, resilient, light-weight and strong compound including recycled rubbers (tires, shoe re-grind and the like) to alleviate environmental pollution and may be adapted for easy attachment to or detachment from any basketball rim, and may be adapted to feature a team logo and/or a manufacturer's name, and/or may be available in variety of colors or in one solid color.

The invention is defined in the appended claims, some of which may be directed to some or all of the broader aspects of the invention set forth above, while other claims may be directed to specific novel and advantageous features and combinations of features that will be apparent from the Detailed Description that follows.

BRIEF DESCRIPTION OF THE DRAWINGS

It is to be expressly understood that the following figures are merely examples and are not intended as a definition of the limits of the present invention.

DETAILED DESCRIPTION OF THE PREFERRED EMBODIMENTS

Figure 1:
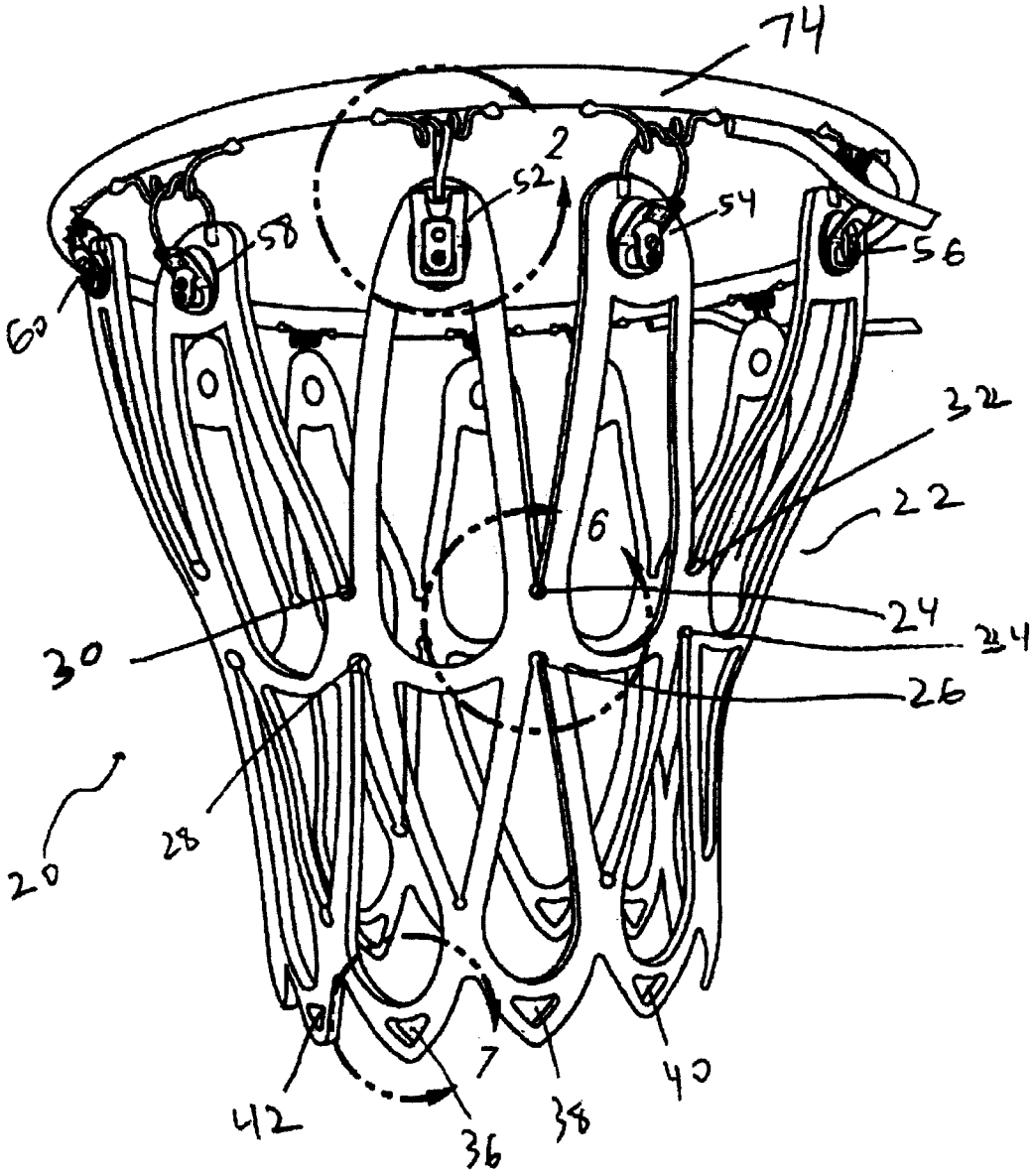
FIG. 1 is a perspective view of a basketball net attached to a single basketball rim in accordance with the present invention.

Hereinafter, some embodiments of the present invention will be described in detail with reference to the related drawings of FIGS. 1–10. Additional embodiments, features and/or advantages of the invention will become apparent from the ensuing description or may be learned by the practice of the invention. In the figures, the drawings are not to scale and reference numerals indicate the various features of the invention, like numerals referring to like features throughout both the drawings and the description. This description is not to be taken in a limiting sense, but is made merely for the purpose of describing the general principles of the invention.

Figure 9:
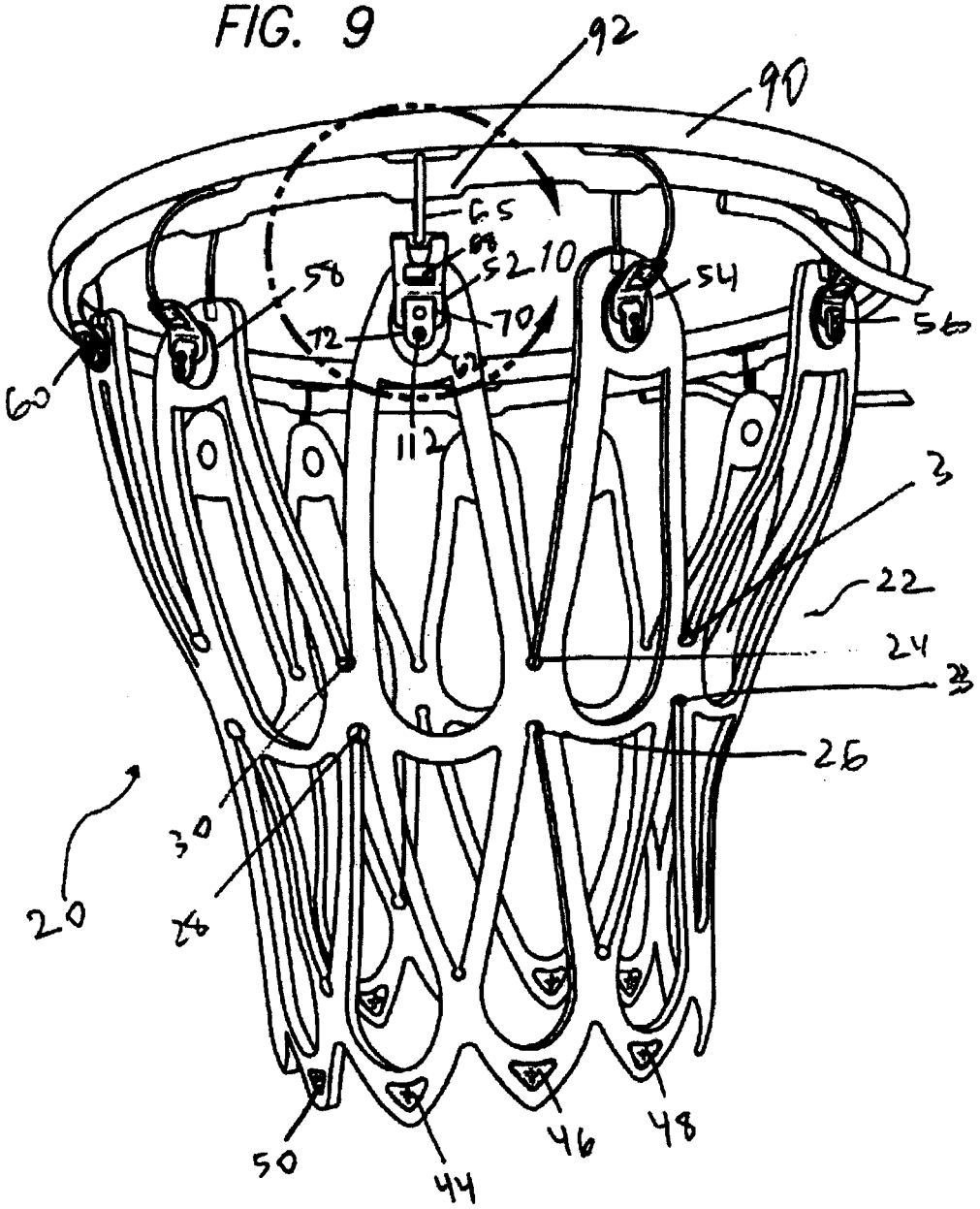
FIG. 9 is a perspective view of a basketball net attached to a double basketball rim in accordance with the present invention.

In accordance with a preferred embodiment of the present invention, a generally conical basketball net 20 manufactured from a durable synthetic rubber compound such as ethylene-propylene-diene rubber (EPDM), which is highly resistant to wear, aging, cracking, heat, cold and mildew, is shown in FIGS. 1, 9. Specifically, ethylene-propylene-diene rubber (EPDM) is produced using a third monomer and is readily available commercially in the United States and/or abroad. EPDM has heat resistance up to 250° F. (max. 400° F. in water and/or steam), cold flexibility to approximately −70° F., chemical resistance to hot water and steam up to 300° F., as well as to many organic and inorganic acids, silicone oil and grease, many polar solvents (alcohols, ketones, esters), ozone, aging and is also weather resistant. Moreover, EPDM is suitable for injection molding, transfer molding, compression molding, or die cutting.

To reduce cost and alleviate growing environmental pollution concerns, about 10% re-grind rubber derived, for example, from used shoe outsoles, midsoles and (a certain percentage of) shoe uppers (e.g., from shoes manufactured by NIKE™, Inc.) is, preferably, added to the EPDM "batter" during manufacturing. For example, typical ingredients for NIKE™ shoe outsoles include styrene butadiene (SBR), polybutadiene (PBD), and natural rubber, with all ingredients being crosslinked. Typical ingredients for NIKE™ shoe midsoles include thermoplastic polyurethane (polyester and polyester-based), ethyl vinyl acetate (thermoplastic), both materials being micro-cellular. Typical ingredients for NIKE™ shoe uppers include nylon, synthetic leather (polyester), leather (protein), cotton, polychloroprene (neoprene sleeves). In general, anywhere from 1% to 51% re-grind rubber may be added (with 10% being the preferred percentage), depending on manufacturing needs. The use of re-grind rubber helps reduce the amount of rubber entering our landfills. Furthermore, re-grind rubber has the same abrasion resistance, durability and overall performance as the highest premium rubber, but is available at much lower cost. When re-grind rubber is added to the EPDM "batter", the resulting material would exhibit small visible colored flecks on the surface. A person skilled in the art would immediately recognize that basketball net 20 may also be manufactured from 100% new EPDM material if cost and/or environmental concerns are not a factor. Alternatively, one of the newer thermoplastic vulcanizate (TPV) rubber compounds may be used, which not only is more advantageous for recycling than EPDM, but also offers potential advantages of lower cost, lighter weight, greater resistance to UV, lower friction, and a broader range of colors.

Basketball net 20 may be injection molded, compression molded or die cut from a rubber compound in a flat sheet configuration with both ends of the sheet provided with integral male/female receptacles (not shown) adapted to interlock together to form a flush finish. The male/female receptacles may also be glued, riveted, sewn or the like. Alternatively, a rotational mold may be used to produce an integral, seamless conical basketball net 20.

Figure 6:
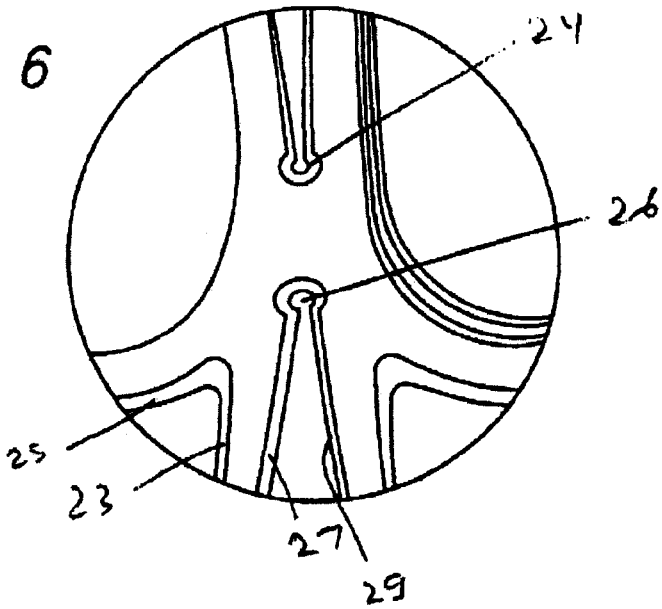
FIG. 6 is an exploded perspective view of a pair of oppositely disposed generally frusto-conical corner cutouts of the basketball net of FIG. 1.
Figure 7:
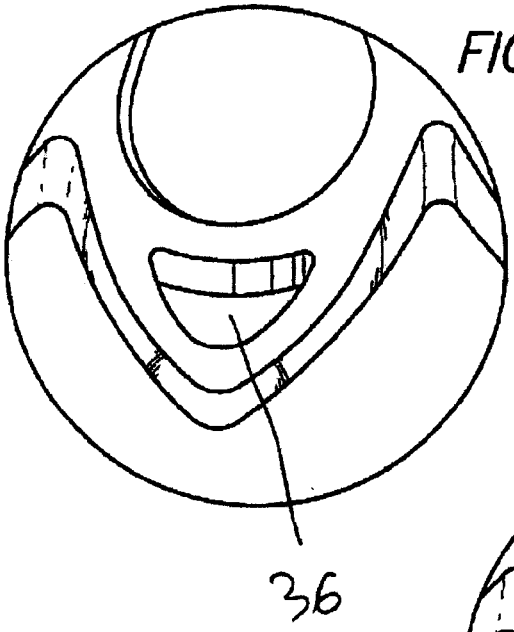
FIG. 7 is an exploded perspective view of a pointed bottom end of the basketball net of FIG. 1 adapted to receive a glowing (logo) insert in accordance with the present invention.
Figure 8:
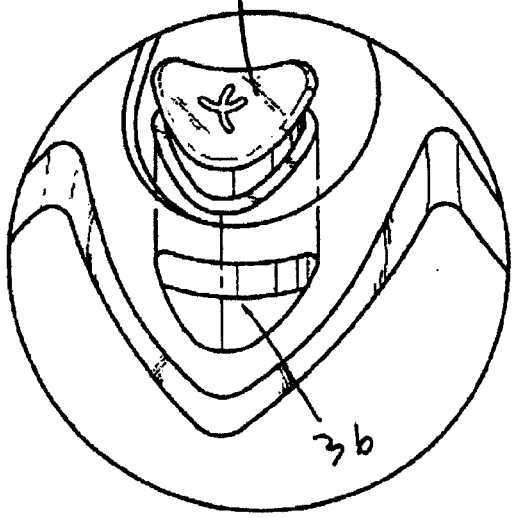
FIG. 8 is an exploded perspective view of the pointed bottom end of FIG. 7 with the glowing (logo) insert in the process of being installed in accordance with the present invention.

To achieve a functional basketball net design, considerable amount of mass must be cut out to produce a resilient net-like structure (body) 22 (FIGS. 1, 9) of sufficient thickness (about ⅛ inch), hardness (about 40-shore to 60-shore) and strength (carry loads of up to about 300 lb) with the inner net walls being of a generally tapered configuration, such as walls 23–29 in FIG. 6. The overall shape of the net and its cutouts is adapted to provide limited friction between the ball and the net, i.e. the performance of basketball net 20 should be similar to a conventional nylon basketball net. The cutouts are produced by die cutting or during the molding/manufacturing process. A connected undulating central waist portion of the body is defined by a series of oppositely disposed upper and lower cutouts to facilitate limited stretching of the net-like body about its waist as the basketball falls through the net. A connected undulating lower portion of the body defined by the lower cutouts facilitates limited stretching of the net-like body about its lower circumference.

In accordance with another preferred embodiment of the present invention, net-like body 22 is provided centrally with a series of integral oppositely disposed generally frusto-conical corner cutouts, such as corner cutouts 24–34 (FIGS. 1, 6, 9). Each corner cutout (e.g., corner cutouts 24–26 in FIG. 6) is partially open on one side to allow net-like body 22 to stretch, as needed, during use so that basketball net 20 always hangs correctly, i.e. in a generally conical configuration.

In accordance with yet another preferred embodiment of the present invention, net-like body 22 is provided at the bottom with a series of generally triangular cutouts, such as cutouts 36–42 in FIG. 1, adapted to receive appropriately shaped advertising inserts, such as inserts 44–50 in FIG. 9. For example, insert 44 (FIG. 8), which snaps (or is glued) in cutout 36 (FIGS. 7–8), may be adapted to carry a team or manufacturer's logo and/or may be made from a luminescent or fluorescent material so that it glows in the dark. A person of skill in the art would undoubtedly recognize that this advertising on basketball net 20 is not restricted to triangular shaped cutouts or inserts, or to glowing inserts 44–50. Non-luminescent material, such as plastic, metal, rubber or foam, could be used. In fact, the entire net may be painted in team colors, or carry other advertising. Furthermore, other parts of net-like body 22 may be adapted to receive glowing inserts (not shown).

Figures 2, 3, 4:
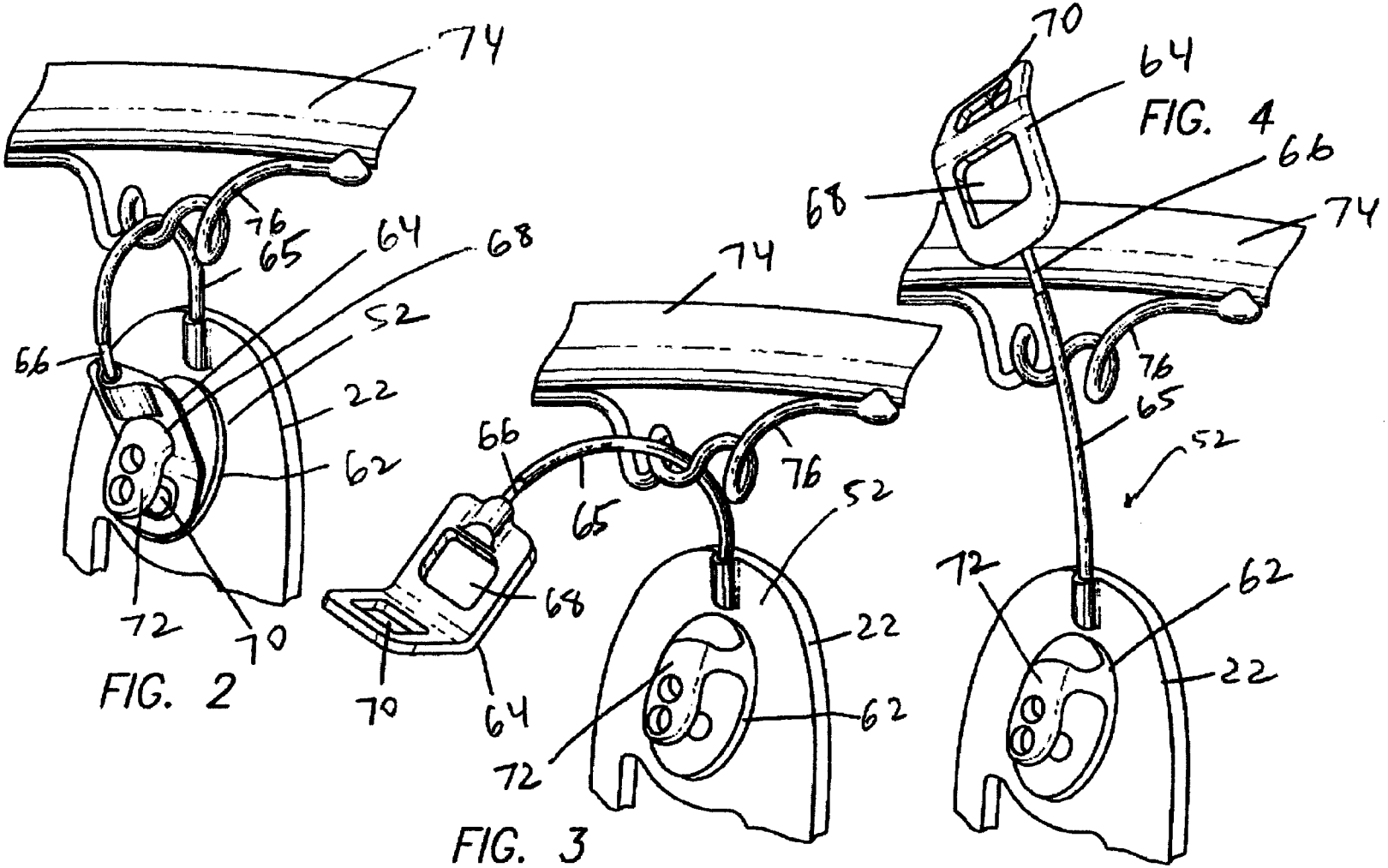
FIG. 2 is an exploded perspective view of a fastener used to attach the basketball net of FIG. 1 to a single basketball rim in accordance with the present invention.
FIG. 3 is an exploded perspective view of the fastener of FIG. 2 in the process of being attached to a single basketball rim in accordance with the present invention.
FIG. 4 is an exploded perspective view of the detached fastener of FIG. 3 being disposed proximate to a single basketball rim.

In accordance with still another preferred embodiment of the present invention, net-like body 22 is equipped at the top with a series (e.g., twelve) of integral basketball hoop fasteners, such as fasteners 52–60 in FIGS. 1, 9. For example, as generally illustrated in FIGS. 2–4, a fastener 52 includes male/female clips 62, 64, respectively, with female clip 64 being attached at one end to male clip 62 via a high-strength (capable of carrying up to 400 lb loads) aircraft cable 66 which is preferably provided with a cylindrical protective cover 65. Female clip 64 is provided with top and bottom apertures 68, 70, respectively (FIGS. 3–5), for coupling with a tongue 72 of male clip 62.

Figure 10:
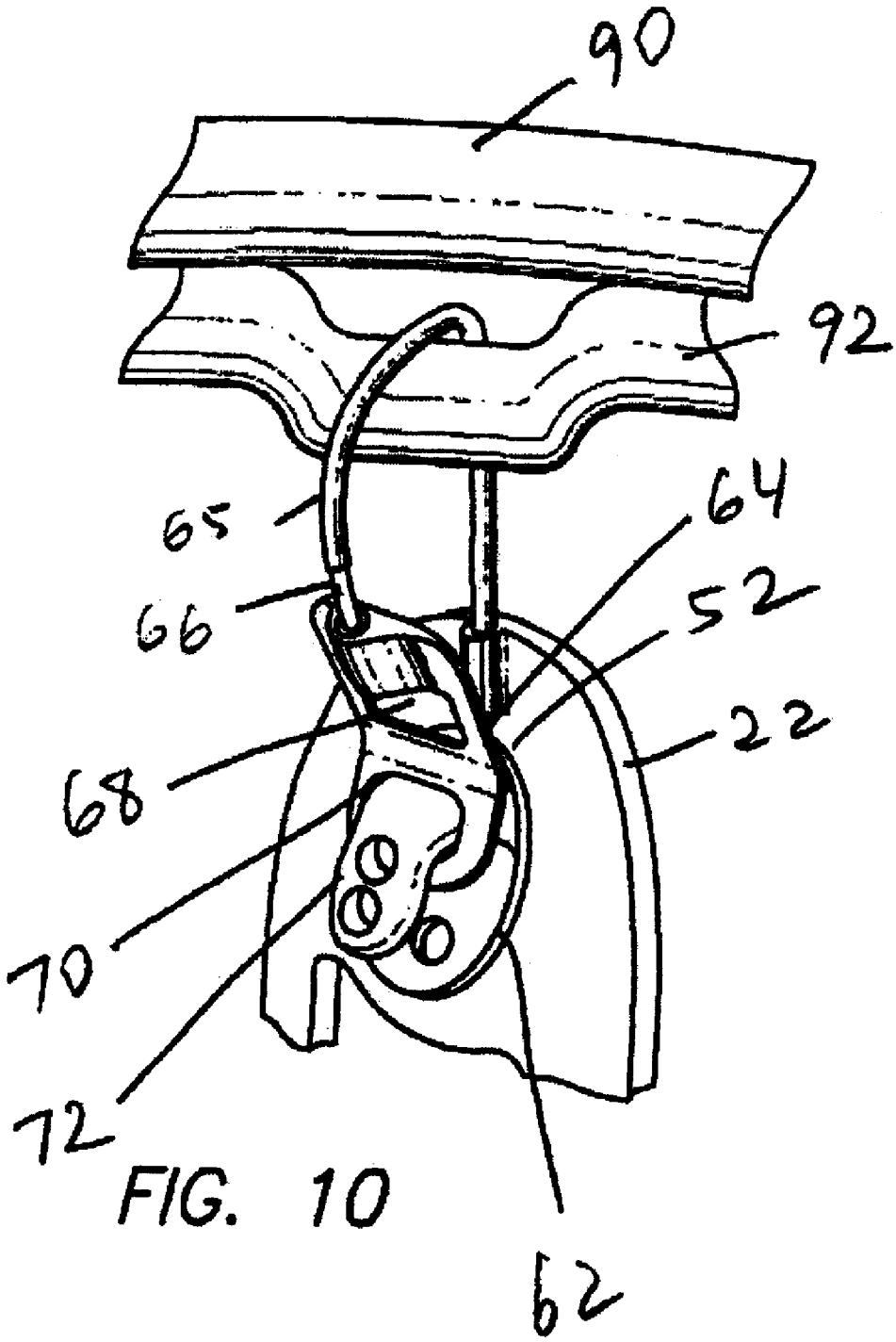
FIG. 10 is an exploded perspective view of a fastener used to attach the basketball net of FIG. 9 to a double basketball rim in accordance with the present invention.

As generally shown in FIGS. 1–2, top aperture 68 is coupled with tongue 72 (to take up the slack) when basketball net 20 is attached to a single rim basketball hoop 74. Bottom aperture 70 is coupled with tongue 72 when basketball net 20 is attached to a double rim basketball hoop 90 (FIGS. 9–10). In the former case, high-strength cable 66, which is securely coupled between male/female clips (62, 64), is supported by a barb-like rim hook 76 of single rim basketball hoop 74, as generally depicted in FIGS. 2–3. Rim hooks of this type are usually made of a short piece of heavy gauge wire welded to the rim. In the latter case, high-strength cable 66 is supported by a second rim 92, as generally illustrated in FIGS. 9–10. In both cases, cable cover 65, which may be made of plastic, rubber, vinyl or similar material, protects the rim/barb-like hook and cable from scratching and fatigue and is of a larger diameter than the diameter of cable 66. A larger cable cover diameter would tend to keep cable 66 centered on rim hook 76, second rim 92, respectively, to help maintain the conical configuration of basketball net 20.

Figure 5:
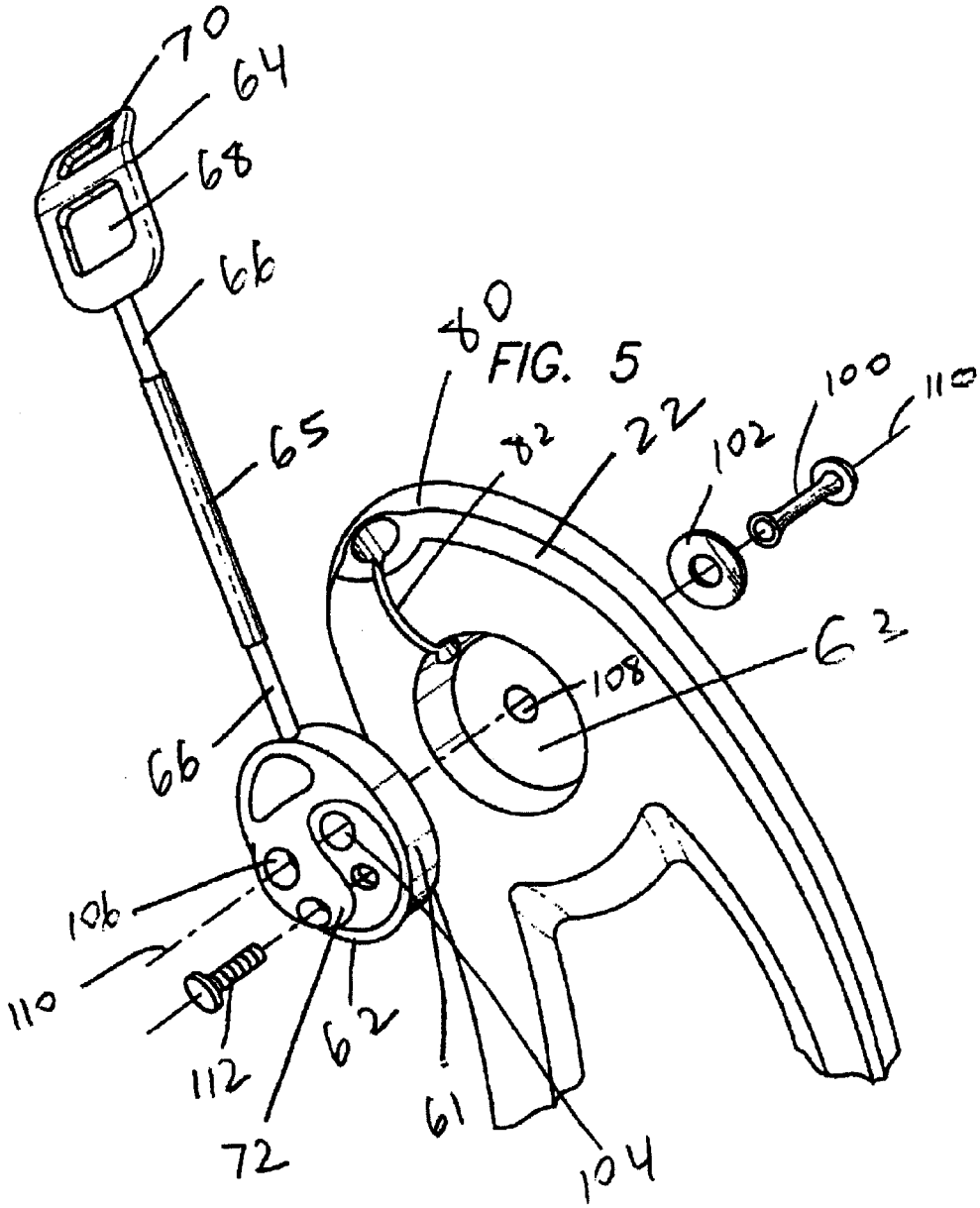
FIG. 5 is an exploded view of the various components of the fastener of FIGS. 2–4.

Each end of cable 66 may be integrally molded in a respective female/male clip during manufacturing, or added during an assembly process. Other means of attaching cable 66 to the clips may be used, provided such other attachment means do not depart from the intended purpose of the present invention. As generally shown in FIG. 5, a top portion 80 of net-like body 22 may be provided with a channel 82 to accommodate a portion of cable 66 during assembly. Alternatively, the same portion of cable 66 may be integrally molded in top end 80 during the manufacturing process.

Each clip is preferably injection molded with glass-filled nylon for strength and durability with each aperture of female clip 64 being adapted to snap onto tongue 72 for removably coupling the basketball net (20) to a single or double-rim hoop.

As generally illustrated in FIG. 5, male clip 62 includes a cylindrical base 61 adapted to be inserted into a circular recess 63 provided on top portion 80 of net-like body 22. After insertion, base 61 is secured to top portion 80 via a rivet 100 and washer 102. Base 61 is provided with a cylindrical opening 104 disposed directly between corresponding first and second cylindrical openings 106 (on tongue 72), 108 (on the bottom of circular recess 63), defining a common central axis 110, to allow for insertion of a rivet tool. Alternatively, base 61 may be placed in a die for an insertion mold eliminating assembly cost and creating permanent bond between male clip 62 and net-like body 22. Yet another alternative would involve (1) bonding cable 66 between male/female clips 62, 64 to produce one integral unit, and (2) placing the integral (fastener) unit in a die for a basketball net insertion mold to completely eliminate assembly cost.

In accordance with a different preferred embodiment of the present invention, base 61 of male clip 62 is adapted to receive a one-way anti-theft screw 112 through its tongue 72, as generally shown in FIG. 5, whenever basketball net 20 needs to be securely coupled to a single or double-rim basketball hoop on a long-term basis. Screws of this type would provide permanent locking arrangement for basketball net 20. In this regard, FIG. 9 shows a basketball net 20 securely coupled to a double rim basketball hoop 90. On the other hand, there is no need to use one-way anti-theft screws if basketball net 20 is mainly used on a short-term basis, i.e. it is easily removed from the rim after play and stored away from the court for safety reasons. This is a marked improvement over conventional nylon and metal chain basketball nets, which are designed to be installed and not removed thereafter.

The above-described novel basketball net, although designed primarily for outdoor use, may also be used indoors. The inventive basketball net is currently estimated to last approximately 5–10 years outdoors which is a significant improvement over conventional nylon basketball nets which when used outdoors on a regular basis tend to require replacement after about a month.

In accordance with an alternative embodiment of the present invention, net-like body 22 may be injection molded from high-density (plastic) foam which is a resilient and light-weight material available commercially in the United States and/or abroad. Net-like body 22 may also be injection molded from high-density foam mixed with virgin rubber or regrind rubber. Regrind rubber is primarily recycled shoe outsoles which contain parts of the midsoles and uppers. The foam net can be made entirely of recycled shoe midsoles or have some percentage of recycled midsoles combined with virgin foam. A basketball net made of such material should preferably be used mostly indoors as plastic foam tends to be less resistant to extreme weather variations and/or chemical agents than the above-described EPDM material.

Other components and/or configurations may be utilized in the above-described embodiments, provided that such other components and/or configurations do not depart from the intended scope of the present invention. While the present invention has been described in detail with regards to the above embodiments, it should be appreciated that various modifications and variations may be made in the present invention without departing from the scope or spirit of the invention. In this regard it is important to note that practicing the invention is not limited to the applications described hereinabove. Many other applications and/or alterations may be utilized provided that such other applications and/or alterations do not depart from the intended purpose of the present invention.

It should also be appreciated that features illustrated or described as part of one embodiment can be used in another embodiment to provide yet another embodiment such that the features are not limited to the specific embodiments described above. Thus, it is intended that the present invention cover all such modifications, embodiments and variations as long as they come within the scope of the present invention as set forth in the appended claims and any equivalents thereof as may now or in the future be apparent to those skilled in the relevant arts.

What is claimed is:

1. An improved basketball net comprising:

an integrally formed resilient net-like body of a generally tapered configuration;

a plurality of straps extending above an upper circumference of the body and each having a respective first end attached to the body; and a plurality of clips each detachably securing a second end of a respective strap to the upper circumference of the body to thereby provide a removeable means for securing the net below a hoop;

wherein a connected undulating central waist portion of the body is defined by a series of oppositely disposed upper and lower cutouts to facilitate limited stretching of the net-like body about said central waist, the upper circumference of the net-like body is defined by a same plurality of elongated rings defined in part by said upper cutouts, said elongated rings being integrally formed with the body and extending upwardly from, and connected to each only in the vicinity of, the waist to thereby provide an adjustable upper circumference, the bottom portions of the lower cutouts are defined by a connected undulating lower portion of the body that facilitates limited stretching of the net-like body about its lower circumference, and each of the straps is secured to a different respective said elongated ring.

2. The basketball net of claim 1, wherein the body is constructed of a material that is not abrasive as to scratch and/or injure players during use.

3. The basketball net of claim 2, wherein the integrally formed net-like body consists essentially of an ethylene-propylene-diene monomer (EPDM) rubber compound including from 1% to 51% re-grind rubber.

4. The basketball net of claim 2, wherein the integrally formed net-like body comprises a thermoplastic vulcanizate (TPV) rubber compound.

5. The basketball net of claim 1, wherein the body has sufficient thickness, hardness and strength to provide durability at least equal to that of a regulation nylon basketball net.

6. The basketball net of claim 5, wherein the thickness is about ⅛ inch, the hardness is about 40-shore to 60-shore and is sufficiently strong to carry a load of about 300 lb.

7. The basketball net of claim 1, wherein the overall shape of the net and its cutouts is adapted to provide an interaction with a regulation basketball similar to that of a conventional nylon basketball net.

8. The basketball net of claim 1, wherein the cutouts are produced by die cutting.

9. The basketball net of claim 1, wherein the cutouts are molded into the body.

10. The basketball net of claim 1, further comprising a series of integral oppositely disposed generally frusto-conical corner cutouts, partially open on one side, to facilitate stretching about the waist and the lower circumference without tearing.

11. The basketball net of claim 1, further comprising one or more adverting inserts placed in corresponding cutouts in the body.

12. The basketball net of claim 1, wherein each said strap comprises a high-strength metallic cable connecting a male clip with a female clip, the male clip is secured to the upper portion of the elongated ring and having a downwardly extending tongue, and the female clip has at least one aperture for coupling with said tongue.

13. The fastener of claim 12 wherein the cable is a high-strength aircraft cable capable of carrying a 400 lb. load.

* * * * *